US006591570B2

(12) United States Patent
Miller, Jr.

(10) Patent No.: US 6,591,570 B2
(45) Date of Patent: Jul. 15, 2003

(54) ARCHITECTURAL POST AND BEAM SYSTEM

(76) Inventor: Robert L. Miller, Jr., 300 Maitland Ave., Altamonte Springs, FL (US) 32701

( * ) Notice: Subject to any disclaimer, the term of this patent is extended or adjusted under 35 U.S.C. 154(b) by 25 days.

(21) Appl. No.: 09/884,538

(22) Filed: Jun. 19, 2001

(65) Prior Publication Data

US 2001/0054269 A1 Dec. 27, 2001

Related U.S. Application Data

(60) Provisional application No. 60/213,134, filed on Jun. 22, 2000.

(51) Int. Cl.[7] ..... E04H 12/34

(52) U.S. Cl. ..... 52/632; 52/736.3; 52/301; 52/736.2

(58) Field of Search ..... 52/632, 126.6, 52/736.3, 738.1, 301, 736.2

(56) References Cited

U.S. PATENT DOCUMENTS 3,280,527 A * 10/1966 Faust ..... 108/106
3,356,330 A * 12/1967 Rambelle ..... 248/354.5
3,594,973 A * 7/1971 Archer et al. ..... 52/115
5,327,694 A * 7/1994 Gamel et al. ..... 249/48
5,555,696 A * 9/1996 Morrison et al. ..... 52/223.4
5,568,709 A * 10/1996 Steckler ..... 29/897.33
6,347,489 B1 * 2/2002 Marshall et al. ..... 248/354.5

* cited by examiner

*Primary Examiner*—Carl D. Friedman
*Assistant Examiner*—Basil Katcheves
(74) *Attorney, Agent, or Firm*—William M. Hobby, III

(57) ABSTRACT

A post and beam construction system has a plurality of telescoping posts, and a plurality of post support bases, each of the bases supporting one of the telescoping posts on one end thereof. A plurality of generally U-shaped brackets are attached to the other end of each telescoping post. A beam is supported and attached to each of the generally U-shaped brackets on the end of each telescoping posts. A decorative foamed polymer cover covers the beam and each of the plurality of telescoping posts and is coated with a fiber reinforced cement coating. The beam has a first and second elongated rib extending from two sides thereof, each rib having a T-shaped cross-section for attaching another structure component thereto.

10 Claims, 3 Drawing Sheets

ARCHITECTURAL POST AND BEAM SYSTEM

This application claims benefit of Prov. No. 60/213,134 filed Jun. 22, 2000.

BACKGROUND OF THE INVENTION

The present invention relates to an architectural post and beam system for building a facade and wall system as part of a building especially as an addition to a building. The present architectural post and beam system might be used in putting a screen enclosure over a patio area adjacent a building or might be used in covering a pool and provides a decorative facade which can be easily manufactured in a plant and then assembled at a building site.

SUMMARY OF THE INVENTION

A post and beam construction system has a plurality of telescoping posts, and a plurality of post support bases, each of the bases supporting one of the telescoping posts on one end thereof. A plurality of generally U-shaped brackets are attached to the other end of each telescoping post. A beam is supported and attached to each of the generally U-shaped brackets on the end of each telescoping posts. A decorative foamed polymer cover covers the beam and each of the plurality of telescoping posts and is coated with a fiber reinforced cement coating. The beam has a first and second elongated rib extending from two sides thereof, each rib having a T-shaped cross-section for attaching another structure component thereto.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
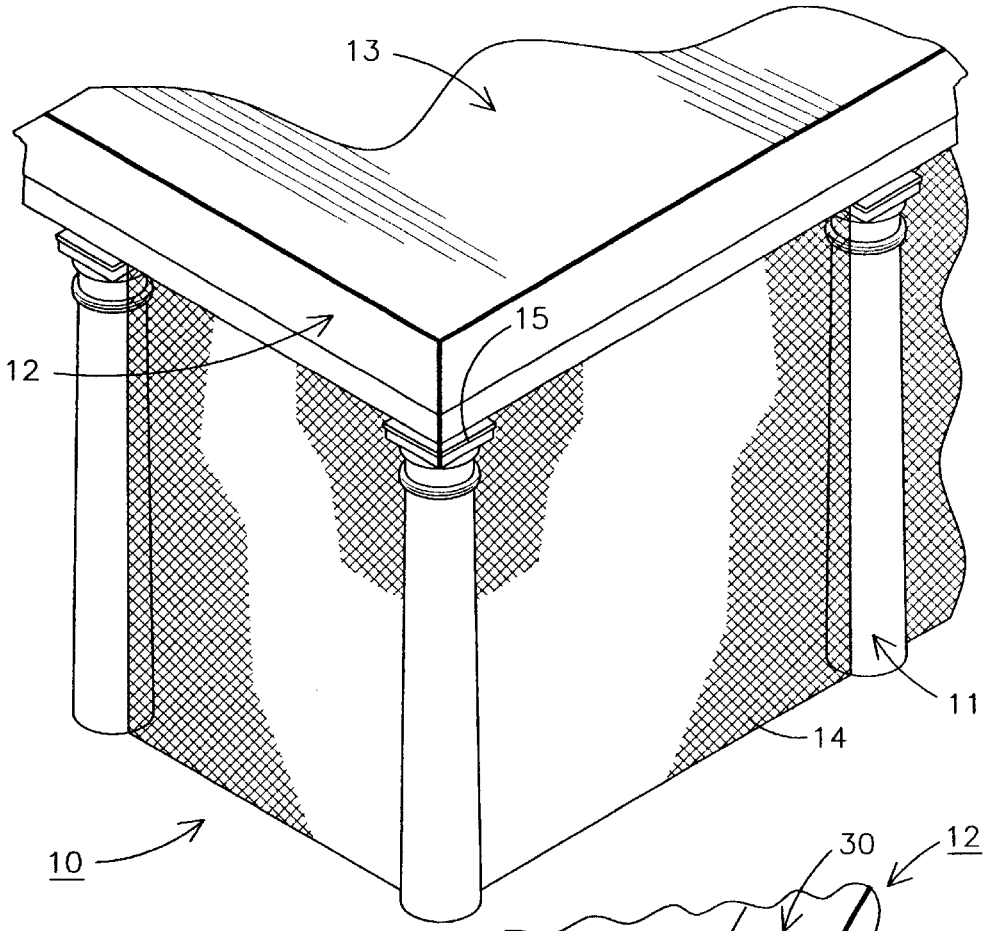
FIG. 1 is a partial perspective view of my architectural post and beam system.

Referring to the drawings and especially to FIG. 1, a post and beam structure 10 has a plurality of columns 11 supporting a beam 12 which in turn supports a roof 13. In FIG. 1, the structure is illustrated having a screen 14 connected between the columns 11 and between the beam 12. The beam 12 can have a decorative design and is supported on the capitals 15 of the columns 11.

Figure 2:
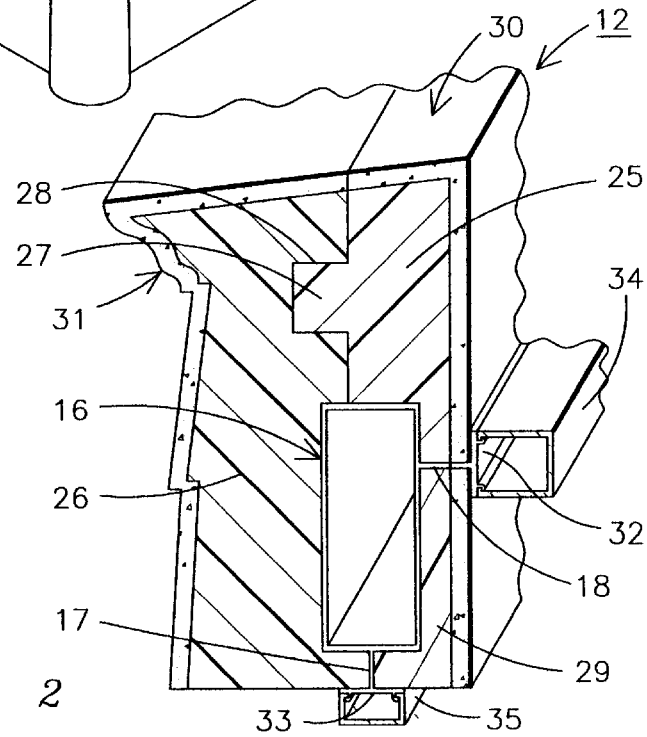
FIG. 2 is a sectional view taken through one of the beams of the system of FIG. 1.
Figure 3:
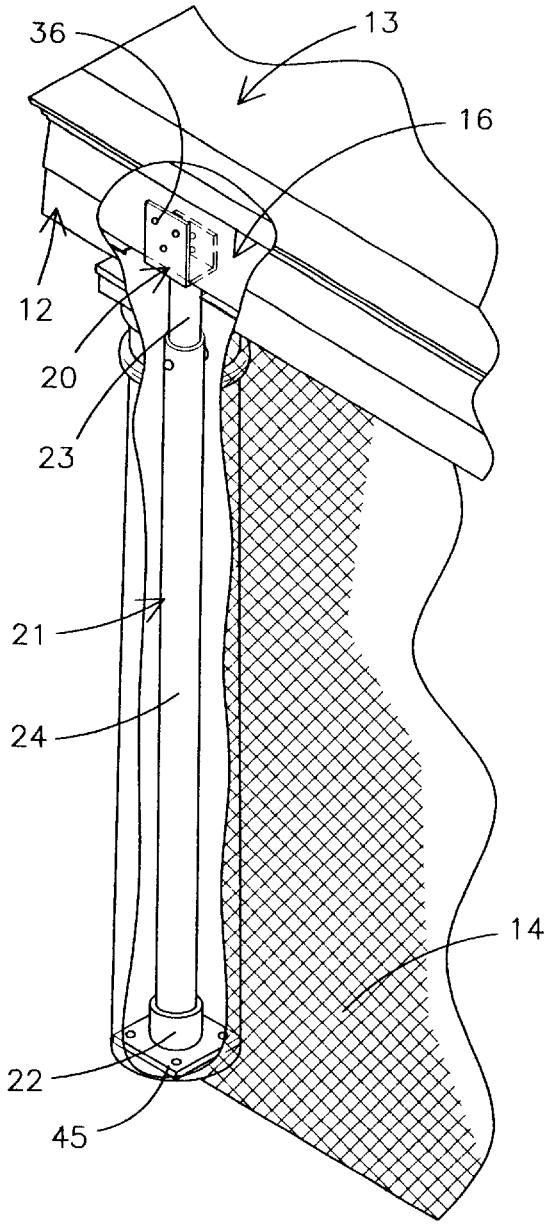
FIG. 3 is a cutaway perspective view of one post and beam connection of the system of FIG. 1.
Figure 4:
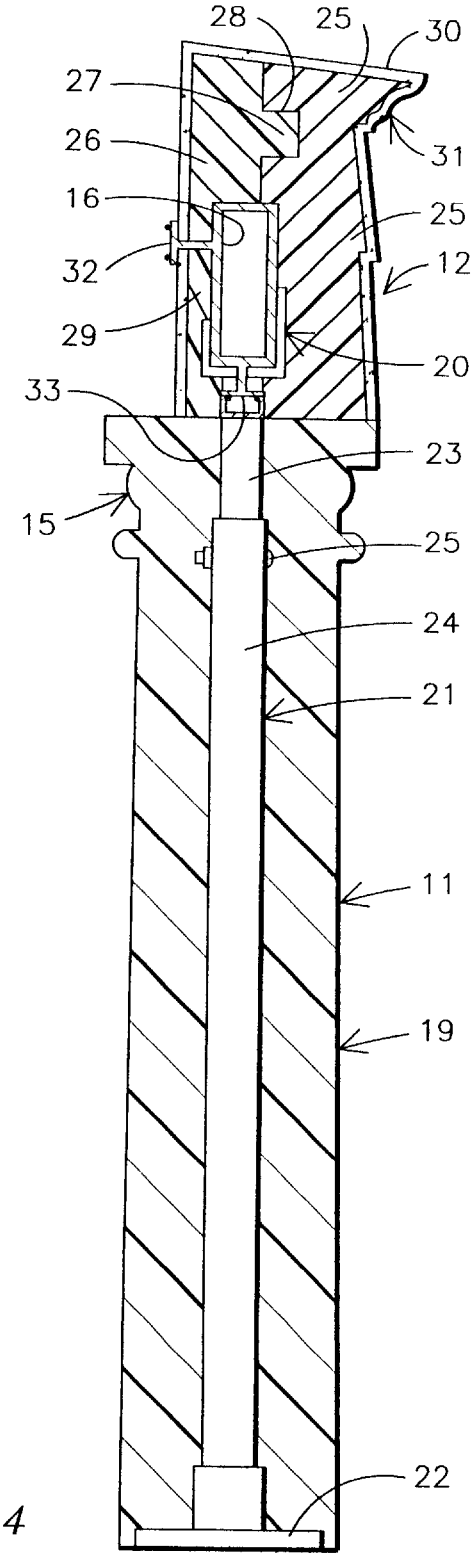
FIG. 4 is a sectional view taken through a beam and column of the architectural system of FIG. 1.

As seen in FIGS. 2–6, the beam 12 is made up of a metal beam channel 16, which may for instance be made of aluminum, having a bottom extension 17 and a rear side extension 18. The beam channel 16 rides in a post supporting sleeve 20 which is a generally "J" shaped bracket which is attached to the top of a steel post 21 covered with a rigid foamed polymer member or with hollow fiberglass or any other column facade. The steel post 21 has a base plate 22 for attaching to a concrete surface, or the like, and is a telescoping post having a telescoping post member 23 telescoping within a post base 24. The post base 24 and telescoping members 23 are locked at a predetermined height with a bolt 25 which is passed through an opening through the post portions 24 and 23. The beam channel member 16 cradles in the post sleeve bracket 20 and has the beam facade attached therearound. The beam facade includes rigid foamed polymer members 25, 26 and 29 which are attached with an adhesive directly over the beam channel 16 and the post sleeve bracket 20, as seen in FIG. 4. The rigid foamed polymer beam components 25 and 26 are put together with an elongated ridge 27 inserted an elongated groove 28 within the rigid polymer foamed beam member 25. The foamed polymer members are covered with a coating 30 of cement which may be mixed with a reinforcing fiber. The foamed polymer members 25, 26 and 29 can be cut from larger strips with laser cutters as desired to get the intricate shapes shown on the front 31 of the beam 12.

The rear protruding member 18 has a perpendicular mounting strip 32 attached thereto on the outside of the beam 12. A second mounting strip 33 is mounted to the extension 17 below the beam for use in attaching screen 14, or any desired wall surface and can be used in attaching the roof members 13. Roof attaching channels 34 can be seen attached to the attaching strip 32 while attaching channel 35 can be seen attached to the attaching strip 33, as seen in FIG. 2. Screen 14 can be readily attached to the channel 35 with self-tapping screws or the like.

Figure 5:
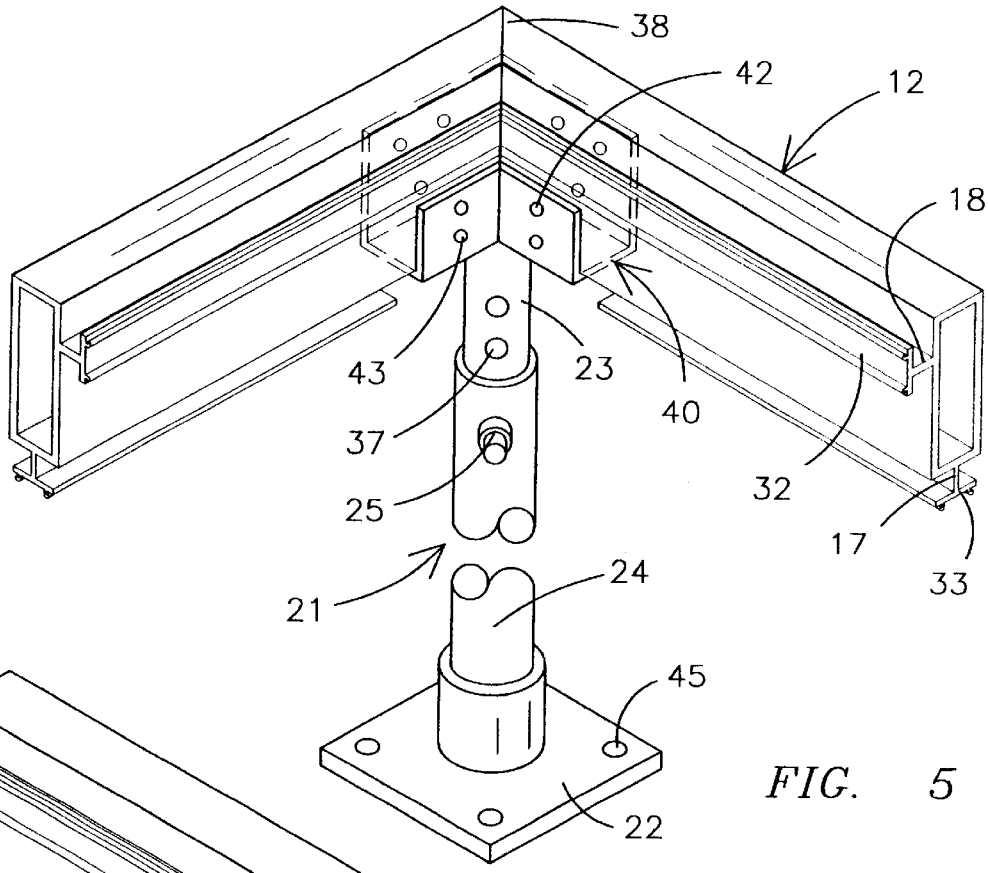
FIG. 5 is a partial perspective of a post and beam corner.
Figure 6:
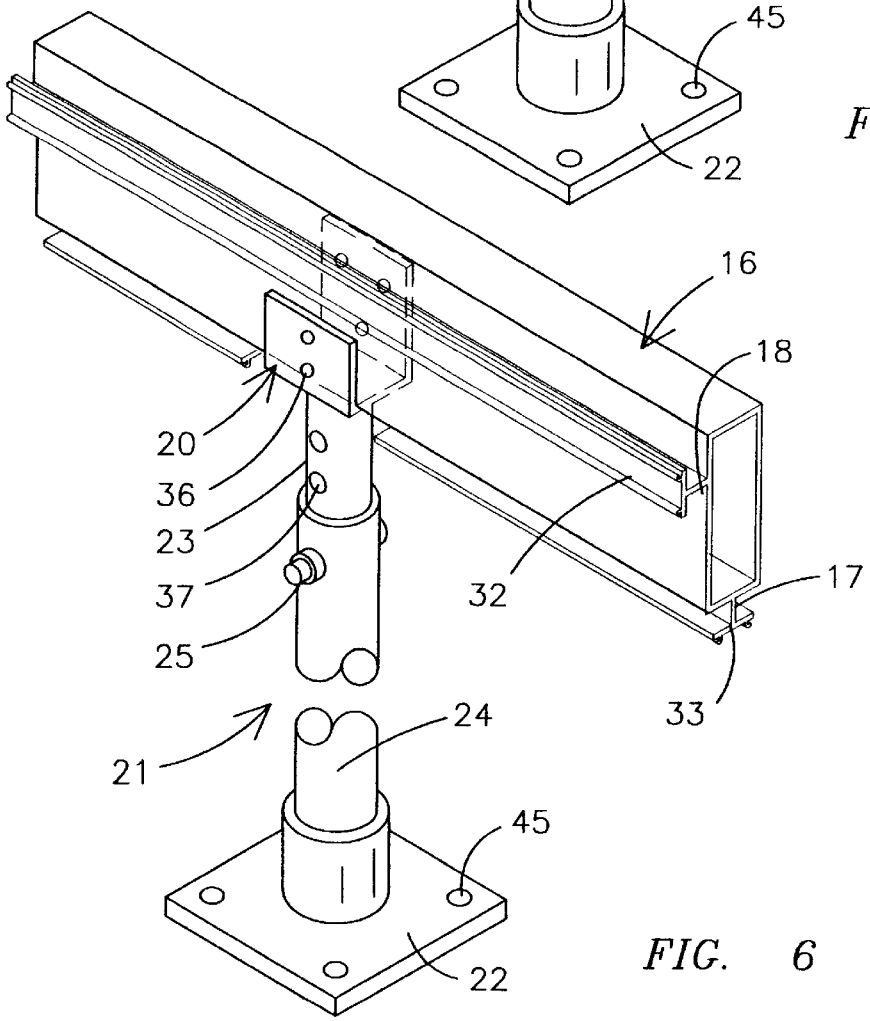
FIG. 6 is a partial perspective view of a post and beam channel.

The supporting beam channel 16 can be seen supported in the post bracket 20 which bracket has a plurality of openings 36 on both sides thereof for attaching the beam channel 16 with threaded fasteners, as seen in FIG. 6. The telescoping post 21 having the base post component 24 and the telescoping portion 23 can be seen having the bolt 25 attached thereto extending through a single opening in the base post portion 24 and one of the plurality of openings 37 in the telescoping portion 23. The corner sections of the beams 12 as seen in FIG. 5 have mitered corners 38 supported by a right angled post brace 40 cradling the mitered end portions of a pair of connecting beams 12. The bracket 41 has openings 42 on one side of the 90° angled support bracket 40 and a plurality of openings 43 on the other side so that both ends of the beams 12 connecting at the corner joint can be attached with a plurality of threaded fasteners.

The method of the present invention includes making a beam channel 16 by extruding a channel, such as by an aluminum extrusion, and then selecting and making a telescoping post 21 having a base portion 24 having a base plate. A concrete footer may be used in place of a base plate to hold the post. The post 21 has the telescoping portion 23 telescoped to the desired height of the column 11. Post 21 can be mounted to a foundation with the base plate 22 adjusted for height and attached to the predetermined height with the bolts 25. The channel beams 16 can then be cut to the predetermined length and mitered at the corner, as shown in FIG. 5, and mounted within the channel beam supporting brackets 20. Once positioned, a plurality of self-tapping screws can be anchored through the openings 36 of the channel brackets 20 to attach the channel beams 16 to the brackets 20 cradled therein and supported on the post 21. The rigid foam members 25, 26 and 29 can be laser cut from blocks of rigid foam material, such as polystyrene, and can be coated with a fiberglass or a reinforced portland cement composition with the coating 30 on the outside portions thereof. The decorative column portions 19 can be cut to shapes having a decorative capital 15 and which may also have a coating, such as a fiberglass or a portland cement-type coating, thereover. The foamed polymer column portions 19 are then mounted around the post 21. The decorative beam portions 25, 26 and 29 are mounted around the beam channel 16, as seen in FIGS. 2 and 4, and is anchored thereto on top of the capital 15 of the column 11. Screens 14 or other facade materials can then be attached to the supporting channels 35 and 34 and roofing sections 13 can be attached to the edge of the beams 12 to provide a complete enclosure. The screens 14, of course, do not have to be attached if an open patio area is desired. The posts 21 can have the bases 22 bolted through bolt openings 45, as seen in FIGS. 3, 5 and 6, directly to a concrete or other supporting floor. In the absence of a concrete floor, a concrete footing can be poured to support the posts 21 base portion 24 without the need for a base plate 22.

As can be seen, the posts 24 are the main support for the building section along with the beam channels 16. The posts can be made of steel while the beam channels are typically made of an extruded aluminum channel cradled in the post brackets 20 while the decorative beam portions and column portions, which are non-supporting materials, can be made of a rigid foamed polymer or plastic sections which can attach around the post 24 and around the beam channels 16. It can be coated with a surface to protect them from damage and to emulate a concrete or marble surface. It has also been found that the coating of a foamed polymer material adds great strength as well as resistance to the weather. The building system in accordance herewith can be rapidly built and provides great strength and decoration to a structure while providing great flexibility in both the design elements and for enclosing a patio.

It should be clear at this time that a post and beam construction system has been provided for making decorative facades extending from building and which is easily manufactured in a plant and then assembled on site. However, the present invention should not be considered as limited to the forms shown which are to be considered illustrative rather than restrictive.

I claim:

1. A post and beam construction system comprising:

a plurality of telescoping posts, each said telescoping post having two ends and having locking means for locking each said telescoping post in a predetermined telescoped position;

a plurality of post support bases, each said base supporting one of said telescoping posts on one end thereof;

a plurality of generally U-shaped brackets, each said generally U-shaped bracket being attached to the other end of one said telescoping post;

a channel beam supported on each said telescoping post in each of said generally U-shaped brackets, said channel beam having a first elongated rib extending from one side thereof having a T-shaped cross-section providing a surface for attaching a structure component thereto;

attaching means for attaching said beam to each said generally U-shaped bracket; and decorative polymer cover covering said beam and each of said plurality of telescoping posts to form a post and beam construction system with a decorative appearance.

2. A post and beam construction system in accordance with claim 1 in which said channel beam has a second elongated rib extending from a second side thereof.

3. A post and beam construction system in accordance with claim 2 in which said second elongated rib has T-shaped cross-section providing a surface on the edge thereof for attaching a structure component thereto.

4. A post and beam construction system in accordance with claim 3 in which said decorative polymer cover includes a plurality of shaped foamed polymer members attached to cover said channel beam and plurality of posts.

5. A post and beam construction system in accordance with claim 4 in which said plurality of shaped foamed polymer members are coated with cement coating.

6. A post and beam construction system in accordance with claim 5 in which said cement coating has reinforcing fibers therein.

7. A post and beam construction system in accordance with claim 6 in which said means for locking said telescoping posts includes locking bolts for a pair of telescoping post members together.

8. A post and beam construction system in accordance with claim 5 in which each said U-shaped bracket has two sides, one side being shorter than other to form J-shaped bracket.

9. A post and beam construction system in accordance with claim 8 in which said channel beam is formed of aluminum channel.

10. A post and beam construction system in accordance with claim 9 in which said attaching means for attaching said channel beam to each said generally U-shaped bracket includes a plurality of threaded fasteners.

* * * * *